United States Patent [19]

Lehner

[11] 4,133,620

[45] Jan. 9, 1979

[54] POLYMER FILAMENT MANUFACTURING DEVICE HAVING REDUCED VERTICAL SIZE

[75] Inventor: Karl Lehner, Essen, Germany

[73] Assignee: Didier Engineering GmbH, Essen, Germany

[21] Appl. No.: 827,810

[22] Filed: Aug. 25, 1977

[30] Foreign Application Priority Data

Aug. 27, 1976 [DE] Fed. Rep. of Germany ..... 2638662

[51] Int. Cl.[2] ..... D01D 7/00

[52] U.S. Cl. ..... 425/72 S; 264/176 F; 425/94; 425/377; 425/382.2; 425/404

[58] Field of Search ..... 264/176 F, 237, 178 F; 425/72 S, 382.2, 378 S, 379 S, 377, 94, 66, 404, 445

[56] References Cited

U.S. PATENT DOCUMENTS

| | | | |
|---|---|---|---|
| 2,838,365 | 6/1958 | Jarrett | 425/72 S X |
| 3,210,451 | 10/1965 | Manning, Jr. et al. | 425/72 S |
| 3,555,139 | 1/1971 | Waters et al. | 425/72 S X |
| 3,719,442 | 3/1973 | Schippers et al. | 425/72 S X |
| 3,720,382 | 3/1973 | Lehner | 425/72 S X |
| 3,999,909 | 12/1976 | Schippers | 425/72 S |

*Primary Examiner*—Richard B. Lazarus
*Assistant Examiner*—Mark Rosenbaum
*Attorney, Agent, or Firm*—Wenderoth, Lind & Ponack

[57] ABSTRACT

A polymer material in liquid form is continuously extruded through the spinning nozzles of a spinning head to thereby form filaments which drop downwardly through a blowing shaft positioned beneath the spinning nozzles. The filaments are entirely cooled, solidified and recrystallized during passage of the filaments through the blowing shaft. A drawing off roller in the form of a guide roller is located at the lower end of the blowing shaft to draw the filaments laterally from the blowing shaft, over a guide roller, and substantially vertically downwardly from the guide roller to a winding machine whereat the filaments are wound up. The winding machine is preferably located laterally of the blowing shaft, with the guide roller positioned at a level which is higher than the level of the drawing off roller. Thus, the filaments move from the drawing off roller to the guide roller in an upwardly inclined direction. The filaments are subjected to any necessary moisturizing and/or treatment operations during the passage of the filaments downwardly through the blowing shaft.

10 Claims, 1 Drawing Figure

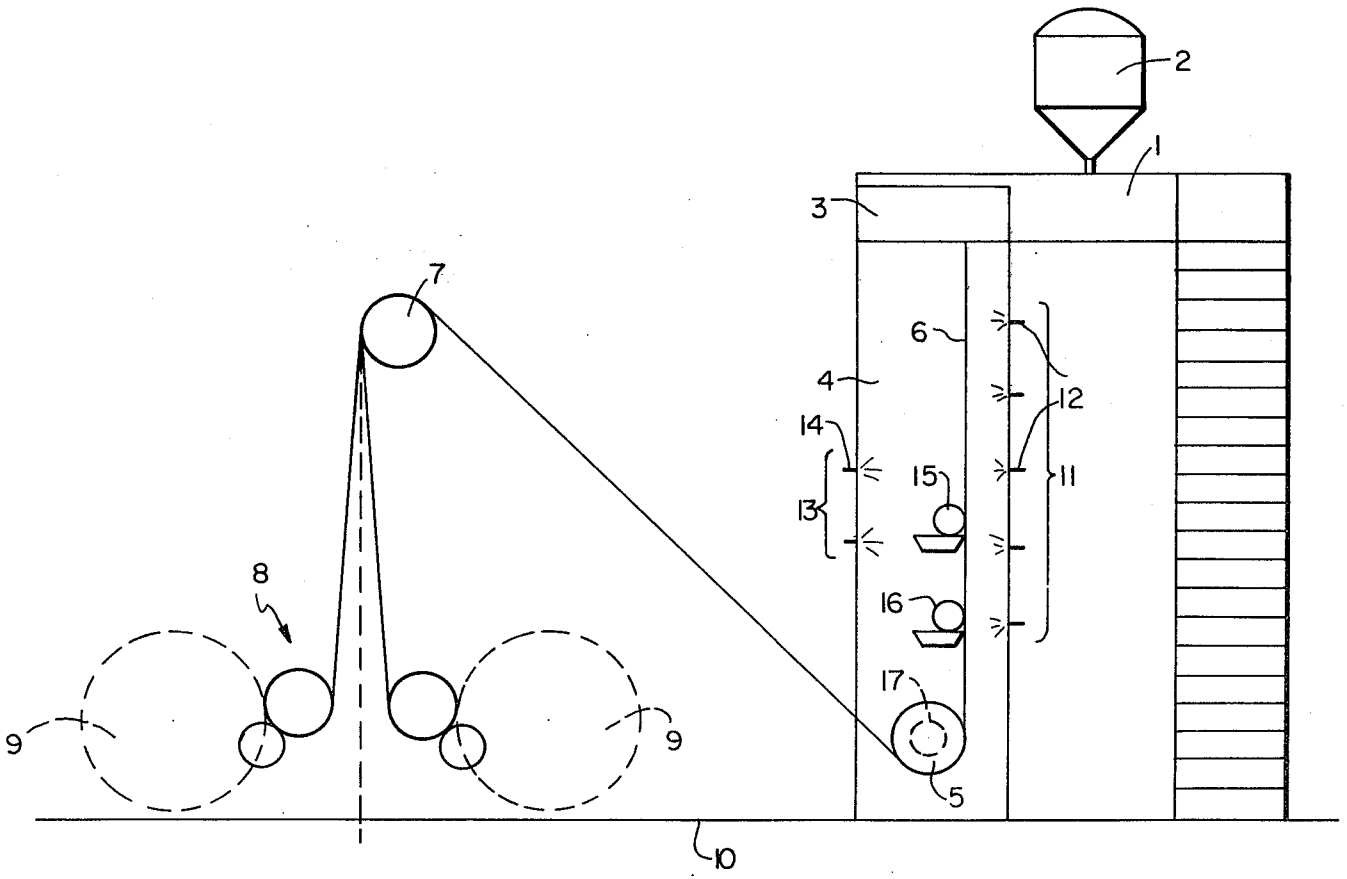
2
1
3
4
6
12
11
14
13
15
16
17
5
10
9
7
8
9

POLYMER FILAMENT MANUFACTURING DEVICE HAVING REDUCED VERTICAL SIZE

BACKGROUND OF THE INVENTION

The present invention relates to an apparatus for continuously manufacturing polymer filaments, particularly polyamide or polyester filaments, wherein the polymer filaments are formed from a fluid polymer starting material which is extruded through spinning nozzles of a spinning head, such filaments then being cooled in a vertical blowing shaft, recrystallized, moistened, possibly subjected to a treatment operation, stretched and wound up.

German DT-OS 19,43,658, corresponding to U.S. Pat. No. 3,720,382, discloses a process and apparatus for the continuous manufacture of a plurality of synthetic filaments, particularly polyamide or polyester filaments, wherein the polyamide or polyester filaments are spun from a spinning nozzle or a plurality of spinning nozzles into a vertically extending blowing shaft. The filaments travel vertically downwardly through the blowing shaft and are subjected to blasts of air for the purpose of cooling and solidifying the filaments. The filaments then continue to pass downwardly through a spinning shaft which is arranged vertically below the blowing shaft. During passage through the spinning shaft the filaments are further cooled and simultaneously recrystallized. After leaving the lower end of the spinning shaft, the filaments are drawn vertically downwardly past a moistening or wetting roller. The filaments then pass over a guide roller arranged below the moistening roller and are then led in a generally horizontal direction to a second guide roller which causes the filaments to return in a substantially horizontal direction over a treatment roller by which the filaments are subjected to any treatment solutions necessary to the formation of the particular filaments involved. The filaments then pass over a third guide roller which directs the filaments in a generally vertically downward direction to a winding-up unit whereat the filaments are wound.

This known type of process and apparatus is an improvement over previous systems, in that a relatively great number of filaments may be produced under uniform conditions.

However, the known type of apparatus and process disclosed in German DT-OS 19,43,658, corresponding to U.S. Pat. No. 3,720,382, requires a considerable amount of vertical space. Specifically, such an apparatus normally requires at least two floors or stories in a building. That is, the winding-up unit is located on the floor of a lowermost story, the lower end of the spinning shaft projects through the ceiling of such lowermost story, and the body of the spinning shaft, the blowing shaft, and the spinning head are positioned successively vertically upwardly. This arrangement takes up at least two floors or stories of a building.

SUMMARY OF THE INVENTION

With the above discussion in mind, the primary object of the present invention is to provide an apparatus similar in purpose to that disclosed in German DT-OS 19,43,658, corresponding to U.S. Pat. No 3,720,382, but which overcomes the above disadvantages.

More particularly, the primary object of the present invention is to provide an apparatus for the continuous manufacture of polymer filaments, particularly polyamide or polyester filaments, whereby the manufacture of such filaments may be carried out in a relatively small space, and particularly in a limited vertical space, i.e. in only one floor or story of a building.

In accordance with the present invention such object is achieved by providing an arrangement whereby the filaments are recrystallized in the blowing shaft and are drawn off in a lateral direction directly from the lower end of the blowing shaft and are then led to the winding machine. Thus, in accordance with the present invention the necessity and use of a spinning shaft are entirely eliminated.

Furthermore, the filaments are not drawn off from the blowing shaft in a generally vertical direction to the winding machine. Rather, the filaments are drawn off to the winding machine which is located generally laterally of the blowing shaft. It will be apparent that this structural arrangement of the filament forming and winding components greatly reduces the amount of vertical space required for the manufacture of such filaments.

In accordance with a further feature of the present invention, an even greater economy of space is obtained by providing that the filaments are led from the lower end of the blowing shaft in an obliquely upward direction, and are then led downwardly to the winding machine.

In accordance with the present invention the filaments are wetted and/or subjected to any other necessary treatment operations while still in the blowing shaft and prior to being laterally removed from the lower end of the blowing shaft.

In accordance with a preferred embodiment of the apparatus in accordance with the present invention, there is provided a fusion extruder including a spinning head having incorporated therein spinning nozzles, such elements being of conventional and known structure, arranged above a blowing shaft. The filaments are extruded through the spinning nozzle and are passed vertically downwardly through the blowing shaft. A drawing off roller is arranged at the lower end of the blowing shaft and directs the filaments laterally, and preferably obliquely upwardly, to a guide roller. The guide roller than causes the filaments to pass generally vertically downwardly to a conventional winding machine whereat the filaments are wound up in a conventional manner. A supply of cooling air or other gas is fed into the blowing shaft, throughout the entire height thereof, or at least throughout a substantial height thereof, to cool and solidify the filaments. To aid in the cooling, solidification and recrystallization of the filaments within the blowing shaft, and to thereby eliminate the need for the heretofore necessary spinning shaft, the drawing off roller may itself be cooled, for example internally cooled. The drawing off roller is a guide roller. The guide roller arranged vertically above the winding machine is also arranged at a level substantially above the drawing off roller, such that the passage of the filaments from the drawing off roller to the guide roller is in an obliquely upward direction. Thus, the winding machine may be located laterally of the blowing shaft, rather than at a level below the blowing shaft as has been required in conventional systems.

A portion of the length of the blowing shaft may be fed with steam to aid in wetting or moisturizing the filaments, such wetting or moisturizing being done in quantities and rates depending upon the particular type of filament involved. Additionally, or alternatively, a conventional wetting or moisturizing roller arrangement may be positioned within the blowing shaft to moisturize the filaments to a known and necessary extent, depending upon the particular type of filaments involved. Even further, it is possible in accordance with the present invention to provide a conventional treatment roller arrangement within the blowing shaft, or a plurality of such arrangements, to subject the filaments to any necessary and otherwise known treatment operation, depending also upon the particular type of filaments involved.

By providing all such otherwise conventional moisturizing and/or treatment arrangements within the blowing shaft itself, and while still ensuring the necessary cooling, solidification and recrystallization of the filaments entirely within the blowing shaft, it is possible to additionally reduce the overall vertical height necessary for the continuous manufacture of polymer filaments, particularly polyamide or polyester filaments.

The entire apparatus, including the fusion extruder, the blowing shaft and the winding machine are arranged in a side-by-side manner on a common frame, whereby the apparatus becomes a unitary system.

BRIEF DESCRIPTION OF THE DRAWING

Other objects, features and advantages of the present invention will be apparent from the following detailed description of one embodiment thereof, with reference to the attached drawing, wherein:

The single FIGURE is a schematic representation of a preferred embodiment of the apparatus of the invention.

DETAILED DESCRIPTION OF THE INVENTION

It is to be understood that the single FIGURE of the drawing is intended to be schematic only, and that the dimensions of the various features thereof are not intended or represented to be accurate. However, those of ordinary skill in the art would be readily able to understand the actual sizes of the various elements to be employed in practice in the manufacture of a particular type of filament.

Furthermore, it is to be understood that the present invention is intended to be an improvement of the apparatus disclosed in German DT-OS 19,43,658, corresponding to U.S. Pat. No. 3,720,382, and those portions of such German publication which are not contradictory to the disclosure of the present application are intended to be incorporated herein by reference.

A conventional fusion extruder 1 is supplied with the necessary materials for the formation of the particular type of polymer filament involved from a supply container 2. The fused material is fed to a spinning head 3 which has incorporated therein a plurality of spinning nozzles. From the spinning nozzles a plurality of threads 6 are extruded downwardly so that they pass vertically downwardly through a blowing shaft 4 arranged beneath the spinning head 3. It is to be understood that elements 1, 2 and 3 may be of any type or construction which are known and conventional in the art for the spinning formation of polymer, and particularly polyamide or polyester, filaments. This arrangement is generally known in the art as a "melt spinning" operation. Adjacent the bottom end or area of the blowing shaft 4 is arranged a drawing off roller 5 in the form of a guide roller which draws filaments 6 from the blowing shaft 4 and supplies such filaments over a guide roller 7 to a winding machine 8. It is specifically to be understood that the guide roller 7 and winding machine 8, including winding spools 9, may be of the conventional type as illustrated in German DT-OS 19,43,658, corresponding to U.S. Pat. No. 3,720,382. The concept of the present invention is not involved in the specific structural configuration of guide roller 7 or winding machine 8. However, a specific inventive feature of the present invention does involve the placement and arrangement of guide roller 7 and winding machine 8 with respect to blowing shaft 4. Specifically, winding machine 8 is located laterally of blowing shaft 4, and not at a level below blowing shaft 4. The necessity of guide roller 7 being arranged generally centrally above winding machine 8 is known and is described in the above noted German publication. However, in accordance with the present invention guide roller 7 is also located at a level substantially above drawing off roller 5. That is, guide roller 7 is arranged sufficiently above the level of drawing off roller 5 such that winding machine 8 may be positioned entirely laterally of and not at a level below blowing shaft 4. Thereby, the entire arrangement shown in the single FIGURE of the drawings may be assembled to and mounted on a common frame, shown schematically at 10, such that the entire filament manufacturing apparatus is extremely compact.

Furthermore, it will be apparent from the above discussion and from the single drawing FIGURE that due to the relative positions of drawing off roller 5 and guide roller 7, such that the filaments 6 extend at a substantial upwardly oblique angle from drawing off roller 5 to guide roller 7, the vertical height necessary for the accommodation of the filament manufacturing apparatus is substantially reduced.

As stated above, the single drawing FIGURE is schematic only. It is to be understood that a plurality of filaments 6 are spun from a plurality of spinning nozzles such that the filaments are arranged in a plane extending perpendicular to the plane of the drawing. It will further be understood that the winding spools 9, shown schematically in the drawing, will also include a plurality of spools spaced from each other in directions perpendicular to the plane of the drawing.

It is to be understood that in accordance with conventional construction, blowing shaft 4 has supplied thereto over substantially the entire height thereof, represented by area 11, cooling air or other gas to cool, solidify and recrystallize the filaments 6. Such cooling air or gas may be supplied transversely to the filaments 6, in any conventional manner, as schematically represented by nozzles 12 in the drawing. It is to be understood that the amount of cooling air or gas would be dependent upon the particular type of filament being manufactured, and that one of ordinary skill in the art would readily understand how and in what manner and locations to supply such necessary quantities of cooling air or gas.

In accordance with a further feature of the present invention there is provided within the blowing shaft 4 itself the means necessary for wetting or moisturizing the filaments 6. Specifically, a portion, schematically represented at 13, of the vertical height of blowing shaft 4 may be in the form of a steaming shaft to provide moisture to filaments 6. Such steaming may be provided in any conventional and known manner, such as represented schematically at 14. In addition to steaming section 13 or alternatively thereto, the interior of blowing shaft 4 may be provided with one or more conventional wetting or moisturizing roller arrangements, such as represented schematically at 15. It of course will be understood that those skilled in the art would readily understand the degree of wetting or moisturizing necessary or desirable for the manufacture of a particular type of filament. Thus, those of ordinary skill in the art would readily be aware of the need for, as well as the location and capacity of, wetting or moisturizing arrangements 13 and/or 15.

In accordance with an even further feature of the present invention, the blowing shaft 4 itself may have arranged therein one or more conventional treatment roller arrangements, shown schematically at 16, for subjecting the particular type of filament involved with any desired or necessary conventional treatment solution. Again, those ordinarily skilled in the art will be readily aware of the types and relative quantities of necessary or desirable treatment solutions to which a given type of filament should be subjected. Accordingly, the precise construction and capacity of treatment arrangement 16 would be readily understood by those skilled in the art.

Even further, to increase the cooling, solidification and recrystallization capacity of blowing shaft 4, drawing off roller 5 itself may be cooled, in addition to the use of the conventional air or other gas cooling system 11. Specifically, drawing off roller 5 may be internally cooled, such as schematically shown at 17 by any known type of suitable heat exchanger.

It is specifically to be emphasized that the internal structural configurations of the arrangements 11 and 17 for cooling, solidification and recrystallization, the arrangement 13 and/or 15 for wetting or moisturizing, and the arrangement 16 for supplying treatment solutions, do not in and of themselves form a portion of the present invention. Rather, the important inventive feature of the present invention is the provision of and arrangement of all of these systems within blowing shaft 4 itself, thereby completely eliminating the need for the heretofore necessary spinning shaft, as well as the heretofore necessary placement of the wetting or moisturizing arrangements and the treatment solution arrangements downstream of the spinning shaft. That is, by the arrangement of the wetting or moisturizing arrangements 13 and 15 within the blowing shaft 4 itself, the overall vertical height of the apparatus is reduced. Furthermore, the provision of supplemental cooling arrangement 17 within the drawing off roller 5 aids the conventional cooling arrangement 11 in ensuring the necessary cooling, solidification and recrystallization of the filaments within the height of the blowing shaft 4.

It is further to be understood that the present invention is not intended to be limited to the specific type of polymer filaments manufactured. Rather, it is intended that the process and apparatus of the present invention encompass the manufacture of any type of polymer, and particularly polyamide or polyester, filaments which involve the supply of a fused material to a spinning head, the extrusion of filaments through spinning nozzles, the cooling, solidifying, recrystallizing, moistening, possible treating, and winding up of the filaments.

It is to be further understood that various modifications may be made to the above specifically described process and structural features without departing from the scope of the present invention.

What is claimed is:

1. An apparatus for continuously manufacturing polymer filaments, particularly polyamide or polyester filaments, said apparatus comprising:

means, including a spinning head having spinning nozzles, for continuously extruding a polymer material in liquid form through said spinning nozzles to form downwardly moving filaments;

a blowing shaft positioned beneath said extruding and filament forming means, such that said downwardly moving filaments pass downwardly through said blowing shaft;

a plurality of nozzle means, vertically spaced along the height of said blowing shaft, for blowing cooling air or gas into said blowing shaft and against said filaments in directions transverse to the direction of travel of said filaments through said blowing shaft, and for thereby cooling, solidifying and recrystallizing said filaments during passage thereof through said blowing shaft;

drawing off roller means, positioned within the lower end of said blowing shaft, for feeding said filaments out of said lower end of said blowing shaft in a direction extending obliquely laterally and upwardly therefrom;

guide roller means positioned downstream of said drawing off roller means, for receiving said filaments directly from said drawing off roller means and for then passing said filaments in a downward direction; and filament winding means positioned beneath said guide roller means for receiving said filaments directly therefrom and for winding said filaments.

2. An apparatus as claimed in claim 1, wherein said filament winding means is positioned entirely laterally of said lower end of said blowing shaft, said guide roller means is positioned at a level above that of said drawing off roller means, and said filaments pass in an upwardly inclined direction from said drawing off roller means to said guide roller means.

3. An apparatus as claimed in claim 1, wherein said extruding and filament forming means, said blowing shaft and said filament winding means are mounted on a single, common frame.

4. An apparatus as claimed in claim 1, wherein said drawing off roller means comprises a drawing off roller in the form of a guide roller positioned in said lower end of said blowing shaft, said drawing off roller including interval cooling means for further cooling, solidifying and recrystallizing said filaments.

5. An apparatus as claimed in claim 1, further comprising means for subjecting said filaments to a moisturizing treatment during passage of said filaments through said blowing shaft.

6. An apparatus as claimed in claim 5, wherein said moisturizing means comprises means for supplying steam into the interior of said blowing shaft.

7. An apparatus as claimed in claim 6, wherein said moisturizing means further comprises at least one wetting roller positioned within said blowing shaft to contact said filaments.

8. An apparatus as claimed in claim 5, wherein said moisturizing means comprises at least one wetting roller positioned within said blowing shaft to contact said filaments.

9. An apparatus as claimed in claim 1, further comprising means for applying a treatment solution to said filaments during passage thereof through said blowing shaft.

10. An apparatus as claimed in claim 9, wherein said applying means comprises at least one treatment roller positioned within said blowing shaft to contact said filaments.

* * * * *